United States Patent [19]

Russell

[11] 4,416,135

[45] Nov. 22, 1983

[54] WIRE COILING MACHINE

[75] Inventor: Frank S. Russell, Northboro, Mass.

[73] Assignee: Sleeper & Hartley Corp., Worcester, Mass.

[21] Appl. No.: 300,758

[22] Filed: Sep. 10, 1981

[51] Int. Cl.[3] ..... B21F 3/027; B21F 11/00; B21F 35/02

[52] U.S. Cl. ..... 72/130; 72/131; 72/132; 72/137

[58] Field of Search ..... 72/130, 131, 132, 135, 72/137, 140; 140/71 R, 92, 102

[56] References Cited

U.S. PATENT DOCUMENTS

| | | | |
|---|---|---|---|
| 3,025,891 | 3/1962 | Clay | 140/71 R |
| 3,983,732 | 10/1976 | Noyce | 72/131 |
| 4,211,100 | 7/1980 | Sykes | 72/137 |
| 4,296,621 | 10/1981 | Ohdai et al. | 72/130 |
| 4,335,758 | 6/1982 | Williams | 140/102 X |

FOREIGN PATENT DOCUMENTS

| | | | |
|---|---|---|---|
| 645877 | 7/1928 | France | 140/92 |

*Primary Examiner*—Ervin M. Combs
*Attorney, Agent, or Firm*—Wolf, Greenfield & Sacks

[57] ABSTRACT

A deflection coiling attachment for a wire winding machine particularly adapted for the making of complex spring configurations employing first and second separately controllable feed means comprising a feed snubber adapted for bi-directional movement and a feed roller mechanism adapted for uni-directional operation. The two separate feeds operate in sequence. In the disclosed embodiment the work station has supported there at a deflection head for forming spring coils, a bending tool and bending anvil for forming spring bends, guide members and a cutting tool. The feed roller drive is cam operated primarily for drive of the wire during the spring coiling sequences. The bi-directional snubber feed controls wire movement for other actions such as during bending sequences.

24 Claims, 23 Drawing Figures

STOP 1
STOP 2
STOP 3
CS1
C5
C6
S1
S2
R2
W

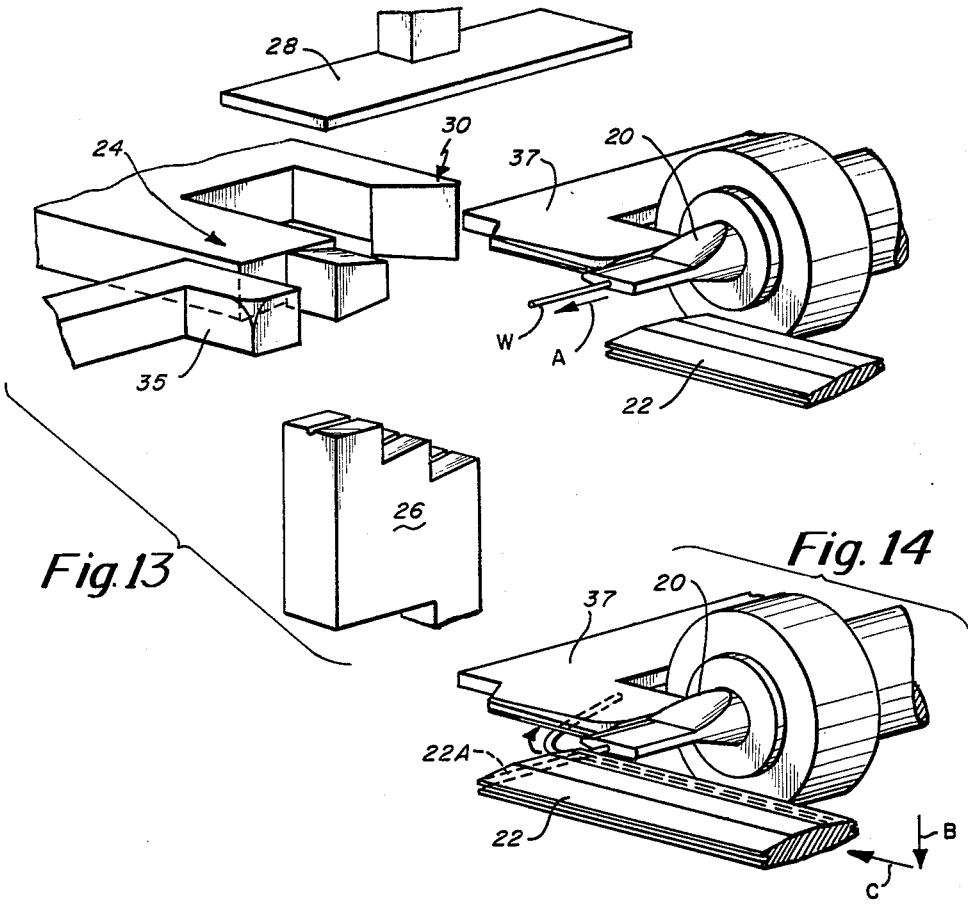
28
30
24
37
20
35
W
A
22
26
Fig. 13
Fig. 14
37
20
22A
22
B
C
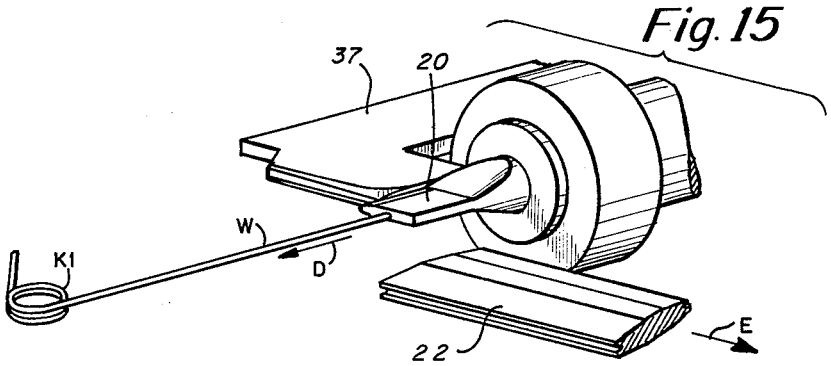
Fig. 15
37
20
W
K1
D
22
E

WIRE COILING MACHINE

BACKGROUND OF THE INVENTION

The present invention relates in general to a wire coiling machine and pertains, more particularly, to a wire coiling deflection attachment for wire winding machines. This enables the machine to have more universal application and one that is readily adapted to the making of springs of varied type particularly ones of complex spring configuration.

Wire coiling machines are well-known particularly those adapted to form nothing more than a standard coil and these machines are adapted for controlling such variables as pitch and diameter. However, when it comes to more complex spring construction this many times requires separate and independent operations on a partially wound spring. It is thus an object of the present invention to provide an improved spring forming machine particularly adapted for making complex spring configurations and which permits multiple types of spring operations along a single feed path. Thus, in accordance with the present invention there is provided an improved feed assembly including a snubber feed for bi-directional control and feed roller feed with the two different types of feeds being operated in a mutually exclusive fashion.

Another object of the present invention is to provide an improved wire coiling machine adapted for making complex spring configurations and which is easily adapted to the making of springs of many different type and form. In the spring construction defined hereinafter in the detailed description, the spring is constructed with both bends and coils. The dual feeding arrangement of the present invention facilitates such spring constructions.

As mentioned hereinbefore, although the present invention relates in general to a wire coiling machine, it relates more particularly to a wire coiling deflection attachment for such machines. This invention relates to a deflection coiling attachment which is applied to a torsioned spring winding machine. Basically, there are two techniques for winding or coiling springs. One technique is a deflection coiling technique, in which the wire is forced against an abutment or deflection head. The second type of coiling uses a rotating arbor wherein the wire contacts the arbor and the arbor rotates to wind the spring thereabout particularly used in making torsion springs.

It is an object of the present invention to provide a deflection coiling type of attachment on a torsion spring machine so as to take advantage of the multiple slide mechanisms presently associated with a torsion machine and using these mechanisms for operating a deflection mechanism associated with the machine. In this way the machine of this invention has more universal capability particularly the capability of secondary forming motions. The standard deflection coiling machine is not so universal and they are generally of special construction adapted only to making coils.

Another object of the present invention is to provide a more universal winding or coiling machine that is adapted to making either compression springs, torsion springs or other types of springs and those having one or more secondary forms. This is accomplished to a great extent in accordance with the present invention by providing two different types of wire feed. The machine includes a linear feeder disposed at a first position along the wire and having associated therewith at a second position along the wire a deflection feeder such as a pair of feed rollers directing the wire to a work station at which a deflection tool and other items are disposed.

SUMMARY OF THE INVENTION

To accomplish the foregoing and other objects of this invention, there is provided a wire coiling machine particularly of the type adapted for making springs of complex style or type such as springs incorporating both coils and bends. There is described herein the construction of a particular spring having end coils and intermediate bends as described in more detail hereinafter. The present invention is particularly related to a deflection coiling attachment for a torsion-type spring winding machine. The machine of the present invention thus incorporates deflection coiling in a machine previously adapted only for torsion spring winding. Thus, the machine of this invention is characterized by the incorporation of at least partial torsion-type drive along with deflection type drive. The wire coiling machine has means for receiving the wire and for supporting the wire along a wire feed path. Within this feed path is disposed a first feed means and adjacent thereto a second feed means. The first feed means is disposed along the feed path and adapted to provide bi-directional wire movement. The second feed means is also disposed along the feed path and is adapted to provide uni-directional wire movement. There is provided a first control means for selectively controlling the first feed means to provide, during a forming operation, wire movement toward a work station, temporary interruption of movement, followed by wire movement away from the work station. This type of control is primarily for providing bends in the wire in the forming of the coil spring. Second control means is also provided for selectively controlling second feed means to provide, during the forming operation, selective wire feed to the work station. At the work station there are disposed a number of tools or the like for providing bending, coiling or the like on the wire during the forming operation. The first feed means may comprise a snubber feed assembly including a carriage means adapted for bi-directional movement of the wire. This snubber feed assembly preferably also includes a pair of beveled gears. As previously mentioned, there is a first control means associated with the first feed means and this may include a first camshaft and associated first cam along with a cam follower coupled to the snubber feed assembly or more particularly, to the beveled gears. This first cam has alobe having a dwell angle corresponding to the period of interruption in movement between the different directional moves. The second feed means comprises a feed roller assembly including a pair of feed rollers. These rollers include a drive roller and a driven roller with the wire being fed therebetween. As mentioned previously, there is a second control means associated with the second feed means and this comprises a selective drive, driving the drive roller and also cam control means comprising a second cam and associated cam follower. Means are provided responsive to the cam follower for pivoting the driven roller out of engagement with the drive roller. In this way there is provided selective driving of the wire from the feed roller assembly. The selective drive means preferably has presettable stops for controlling the selective driving thereof.

At the work station of the machine there are disposed a number of tools and the like including a guide plate means having associated therewith a third cam mounted on a camshaft for controlling movement of the guide plate toward and away from the work station. The guide plate is operable for contact with a leg of the spring to impart natural spring action to the spring. There is also disposed at the work station a bending tool and associated fourth cam. All four cams are disposed on a common first camshaft. The fourth cam is for controlling vertical movement of the bending tool. This fourth cam preferably has two lobes in sequence of different height to move the bending tool to two different bending positions. At the work station there is also provided a bending anvil and a fifth cam associated with a second camshaft. The fifth cam is for controlling the horizontal movement of the bending anvil. The fifth cam has three lobes, two of which control displacement of the bending anvil to two different bending positions. There is also provided a cutting tool at the work station with the third lobe of the fifth cam controlling the operation of the cutting tool. Preferably, the bending anvil and the cutting tool are commonly mounted and thus controllable by the same fifth cam. The bending tool and bending anvil are operated in unison to form bends in the wire during a forming operation. In order to form coils, there is provided, at the work station, a deflection tool having associated therewith a sixth cam also mounted on the second camshaft. This sixth cam is for controlling movement of the deflection tool. The deflection tool is operated to form coils in the wire with the bending and coiling sequences being performed mutually exclusively. The horizontal movement of the deflection tool is controlled by the sixth cam while its vertical movement is controlled by an air cylinder also operated in the proper sequence. In accordance with the forming operation described herein, a first coil is imparted to the wire, followed by two right angle bends, and then the second coil is formed to complete the spring. After the second coil is formed then the cutter is operated to cut the last leg of the spring to the proper length.

BRIEF DESCRIPTION OF THE DRAWINGS

Numerous other objects features and advantages of the invention should now become apparent upon a reading of the following detailed description taken in conjunction with the accompanying drawings, in which:

FIG. 13 is a perspective view at the work station showing the wire initially being fed from the feed guide;

FIG. 14 is a perspective view at the work station showing operation of the deflection tool and forming the first coil of the spring;

FIG. 15 is a perspective view at the work station showing the first coil having been formed and the wire feed proceeding;

DETAILED DESCRIPTION

Figure 1:
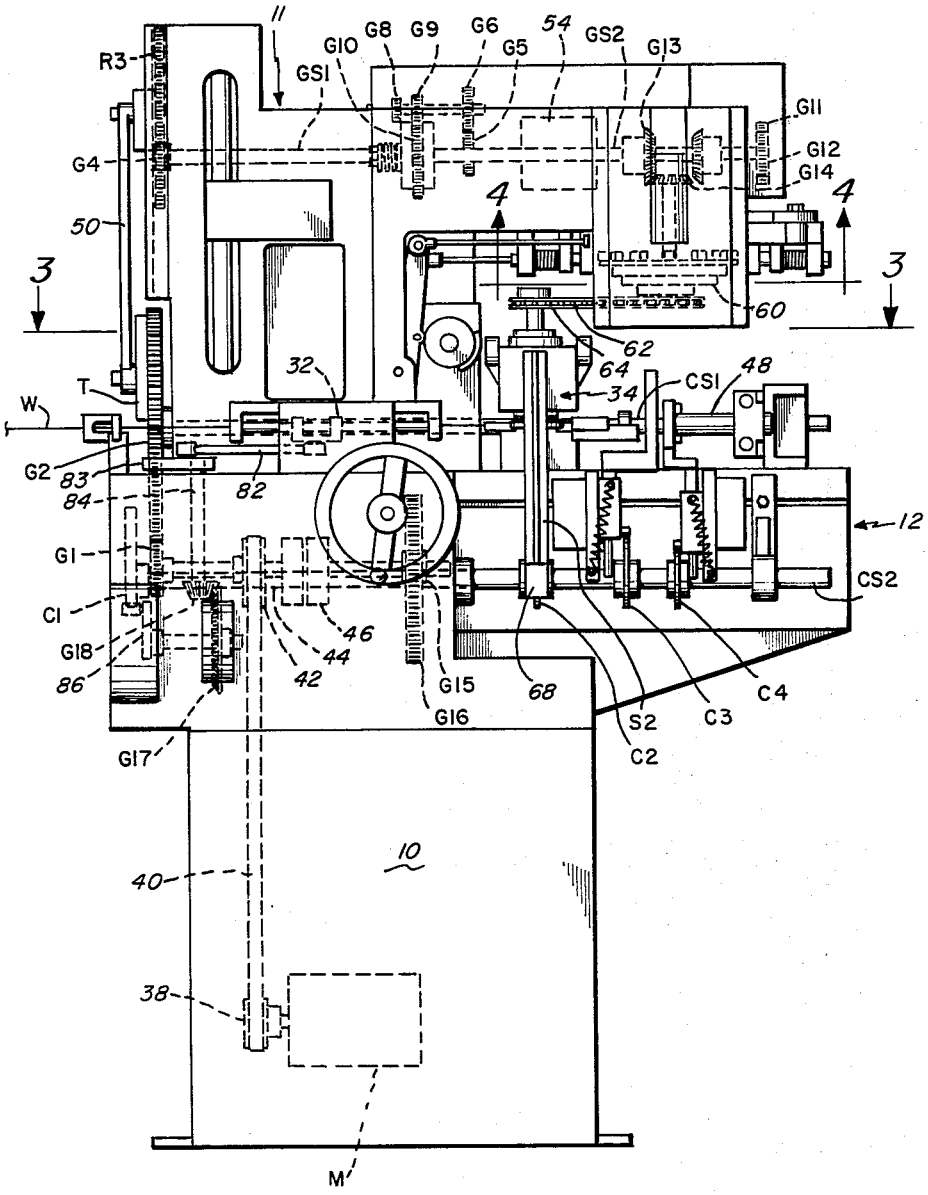
FIG. 1 is a front elevation view of a wire forming machine in accordance with principles of the present invention.
Figure 2:
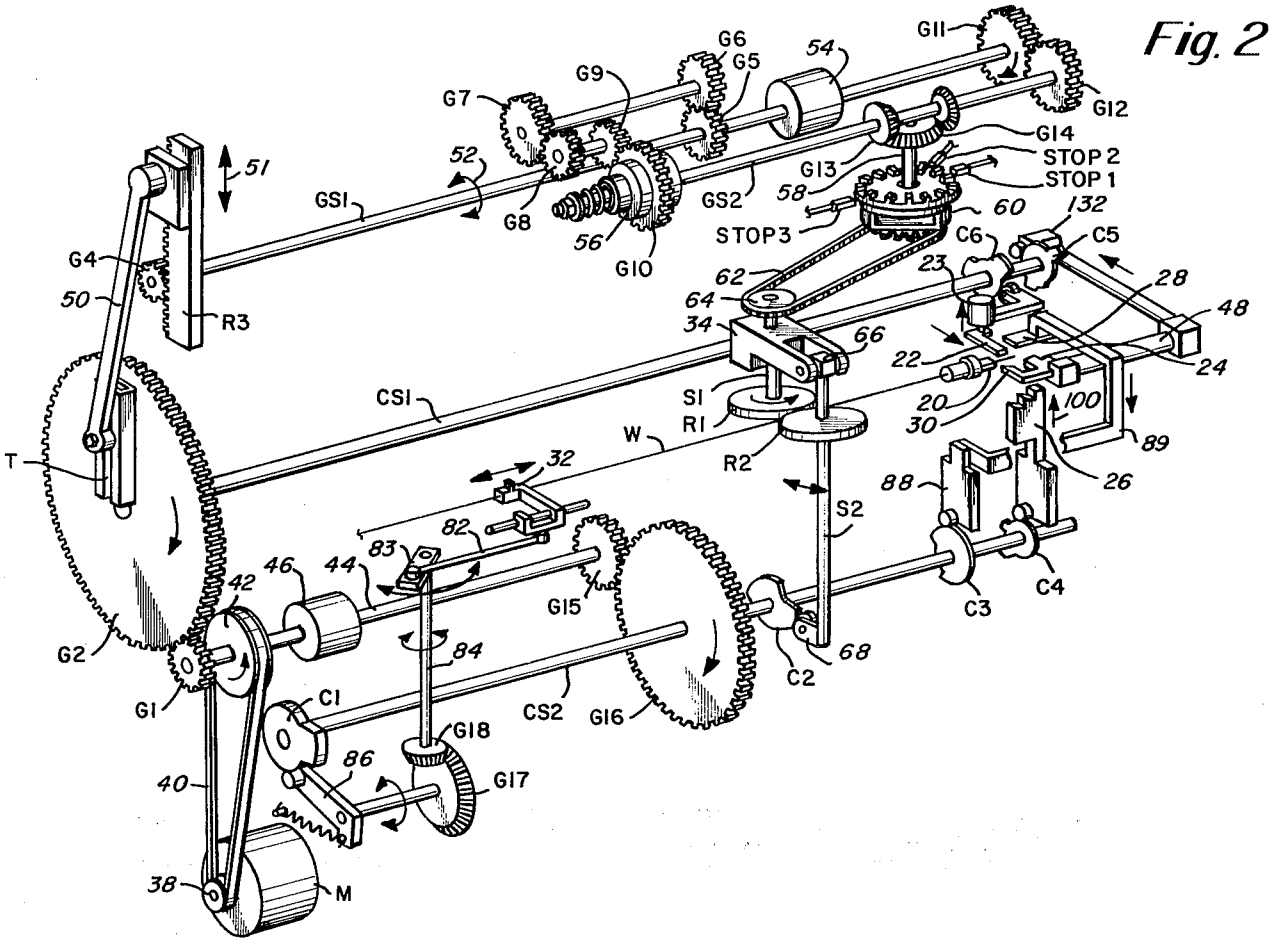
FIG. 2 is a schematic perspective view showing the majority of the operative parts of the machine of FIG. 1 including the gears that are used and associated gear shaft and the operable cams and associated camshafts along with the feeding mechanisms and the tools and the like that are provided at the work station.
Figures 3, 4, 5:
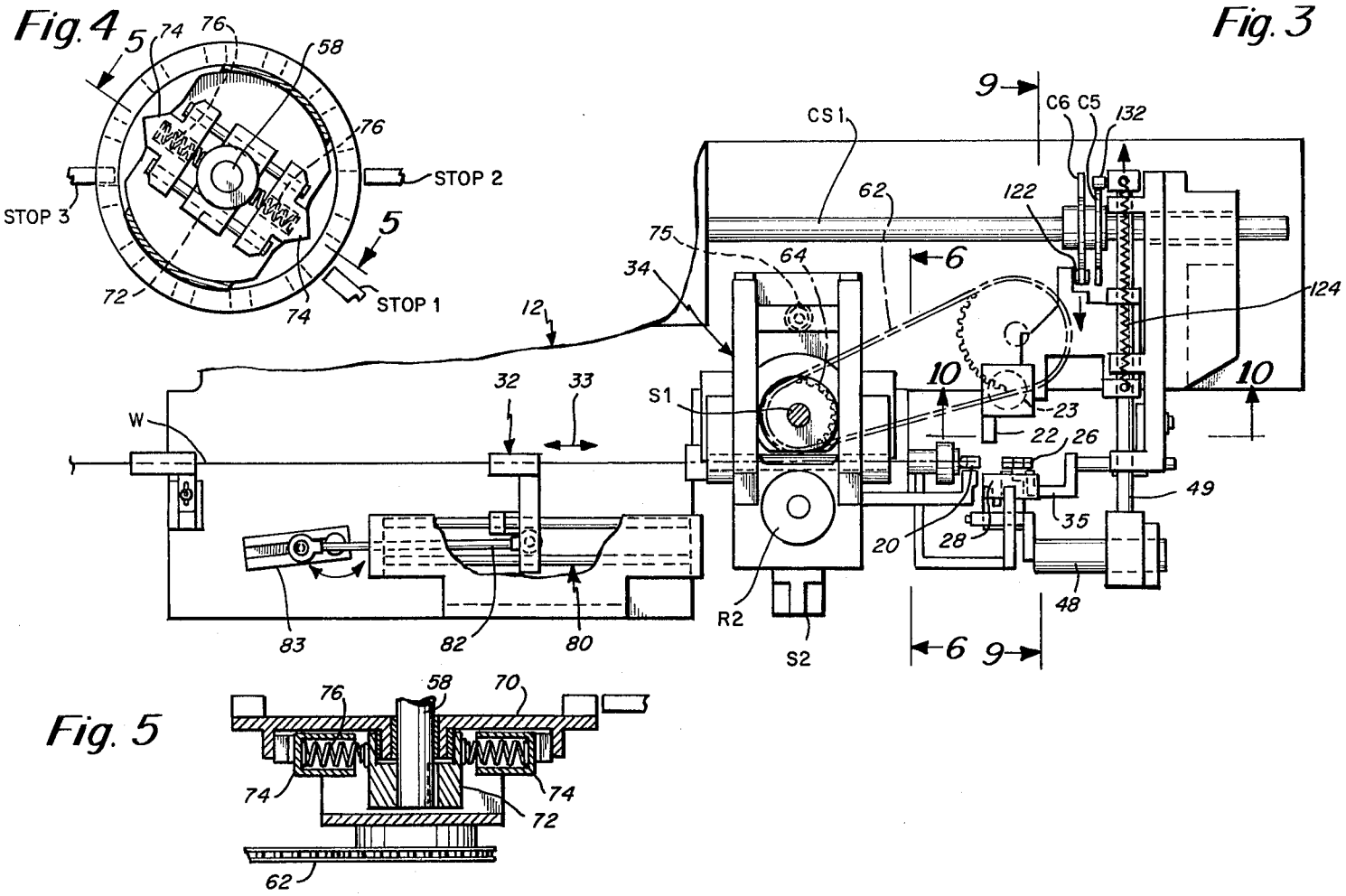
FIG. 3 is a cross-sectional view taken along line 3—3 of FIG. 1 essentially showing a top view of the wire feed path.
FIG. 4 is a cross-sectional view taken along line 4—4 of FIG. 1 showing the construction for the selective feed drive.
FIG. 5 is a cross-sectional view taken through the construction of FIG. 4 along line 5—5.

Referring now to the drawings, and in particular to FIGS. 1–3, there is shown a wire coiling machine constructed in accordance with the principles of the present invention. The machine comprises a substantial and rugged frame for supporting the various components comprising the machine such as many of the gears and cams shown in FIG. 2 and more specifically identified hereinafter. Many of the frame components are not described in detail herein in order to simplify the description. Furthermore, it is understood that these frame parts support the various other components of the machine in a substantially known manner. For example, the support of components such as the motor M shown in FIGS. 1 and 2 is conventional.

The overall construction in FIG. 1 is in the form of a torsion spring winding machine. However, there is associated with the machine a deflection coiling attachment. In this regard, rather than having an arbor drive which is characteristic of a torsion spring winding machine, there is incorporated a deflection coiling feed such as the use of a pair of feed rollers to be described hereinafter.

Generally speaking, the frame of the machine is separated into three sections including a base 10, top section 11, and intermediate section 12. For example, the gear shafts GS1 and GS2 are suitably supported in the top section 11. The camshafts CS1 and CS2 are generally supported in the intermediate section. A component of the machine such as a motor M is suitable supported in the base 10.

The motor M has an output pulley 38 adapted to drive the belt 40 which in turn drives the pulley 42 secured to the shaft 44. The perspective view of FIG. 2 clearly depicts this motor drive and also clearly shows the camshafts and gear shafts. At one end of the shaft 44 there is disposed the gear G1 which directly drives the larger gear G2. At the opposite end of the shaft 44 is disposed the gear G15 which is intermeshed with the larger gear G16. It is by way of the gears G15 and G16 that the camshaft CS2 is driven from the input shaft 44. Disposed at an intermediate position on the shaft 44 is the electric clutch 46.

The drive to the camshaft CS1 is by way of gears G1 and G2. The cams C5 and C6 are mounted to one end of the camshaft CS1. The cam C6 is used in the operation of the deflection head 22. Also associated with the deflection head 22 is the air cylinder 23. The cam C5 described hereinafter, has associated therewith a cam follower 48 for operating the bending anvil 24 and cutting tool 30 which are mounted commonly.

The gear G2 has radially mounted theeon a track T along which may be adjustably positioned in a fixed position, the connecting arm 50. The top of arm 50 is connected to the rack R3 and as the gear G2 rotates, the rack is moved in the direction of the arrow 51 shown in FIG. 2. This motion is conveyed to gear G4 on gear shaft GS1 so as to provide rotation of this gear shaft as indicated by the rotating arrow 52.

The gear shaft GS1 also supports at an opposite end, the gear G11 and at intermediate positions, the gear G5 and the one-way clutch 54. The clutch 54 permits rotation of the gear G11 in only one direction. The gear G11 is intermeshed with the gear G12 on the gear shaft GS2.

The gear G5 driven on the gear shaft GS1 controls gears G6, G7, G8, G9 and G10. The gear G10 is supported on the friction clutch 56 associated with gear shaft GS2. This gear arrangement provides for selective driving of the bevel gear G14 by way of gears G12 and G13. The shaft 58 from the bevel gear G14 drives the wedge drive member 60. The member 60 has associated therewith, stop 1, stop 2, and stop 3 disposed as depicted in FIGS. 2, 4 and 5. The drive member drives the chain 62. The chain 62 in turn drives a sprocket 64 on the feed assembly 34. The feed assembly 34 supports feed rollers R1 and R2. Of these feed rollers, the roller R1 is the drive roller which is selectably driven from the member 60. The other feed roller R2 is selectively engaged with the roller R1 to drive the wire W. The feed roller R1 is supported on shaft S1 while the roller R2 is supported on member S2. The member S2 is actually a member that pivots at 66 from the assembly 34. The member S2 connects at its bottom to the cam follower 68 operated from the cam C2.

FIGS. 4 and 5 depict the wedge drive member 60. The shaft 58 is supported within top disc 70 and is keyed to body 72. There are provided wedge pieces 74 which are diametrically disposed as shown in FIGS. 4 and 5. These wedge pieces are biased by springs 76 to extend radially. The stops depicted in FIGS. 4 and 5 are operated to extend inwardly to stop rotation of the wedge drive member. In this way the drive roll R1 is operated in a selective manner for predetermined movement of the wire into which a spring is coiled. The stops are preferably rotatably positionable and are shown in FIGS. 4 in their preferred position for providing operation as described hereinafter.

In accordance with one important feature of the present invention, it is noted that there is a dual form of feed including, in addition to the feed rollers, R1 and R2, the feed snubber 32. The snubber 32 traverses in the direction of the arrow 33 in FIG. 3. For this purpose, the snubber 32 moves upon a carriage 80. The movement is controlled by a mechanical arrangement including arm 82, pivot member 83, and shaft 84. The shaft 84 is connected to bevel gear G18 which in turn is intermeshed with bevel gear G17. This gear arrangement is operated from follower arm 86; which in turn is operated from the cam C1 associated with camshaft CS2. FIG. 2 depicts these components and also shows the direction of movement of most of these components. The feed 32 controls the wire bi-directionally as will be described hereinafter. However, the mechanism permits the wire to be drawn therethrough under other feed control such as by means of the feed rollers R1 and R2. Thus, the snubber 32 is in the form of a slip clutch.

As indicated in FIG. 2, on the other end of the camshaft GS2 there is disposed a set of cams including cams C2, C3 and C4. It is the cam C2, mentioned previously, that operates the feeding of the wire W by manipulation of the feed roll R2. The cam C3 operates the follower 88 which interconnects by link 89 to the guide plate 28. The cam C4 operates the bending tool 26. The operation of both the guide plate 28 and the bending tool 26 is discussed in more detail hereinafter, particularly in connection with the construction of a particular form of coil spring.

In FIG. 2 many of the components, particularly the gearing is of the type found in a torque winding machine. However, in place of the arbor drive there is provided the feed drive mechanism 34 having associated therewith the feed rollers R1 and R2. Furthermore, the slides normally associated with a torque spring winding machine are adapted for use in adapting the overall machine to deflection coiling. It is thus noted that in accordance with the present invention there is provided both the feed 32 which is adapted for bi-directional operation and the deflection drive which is characterized by confinement of the wire particularly from the feed rollers to the point where the wire is deflected. FIG. 2 does not show this confinement because it is simply a schematic diagram but reference to the detailed drawing shows the wire being confined in its path of travel so as to enable it to be driven with force against the deflection tool. The snubber feed on the other hand does not require such confinement as the wire movement is not made with force against a deflection tool but instead movement is for changing the position of the wire for some forming operation such as the provision of a bend as described herein.

Figure 6:
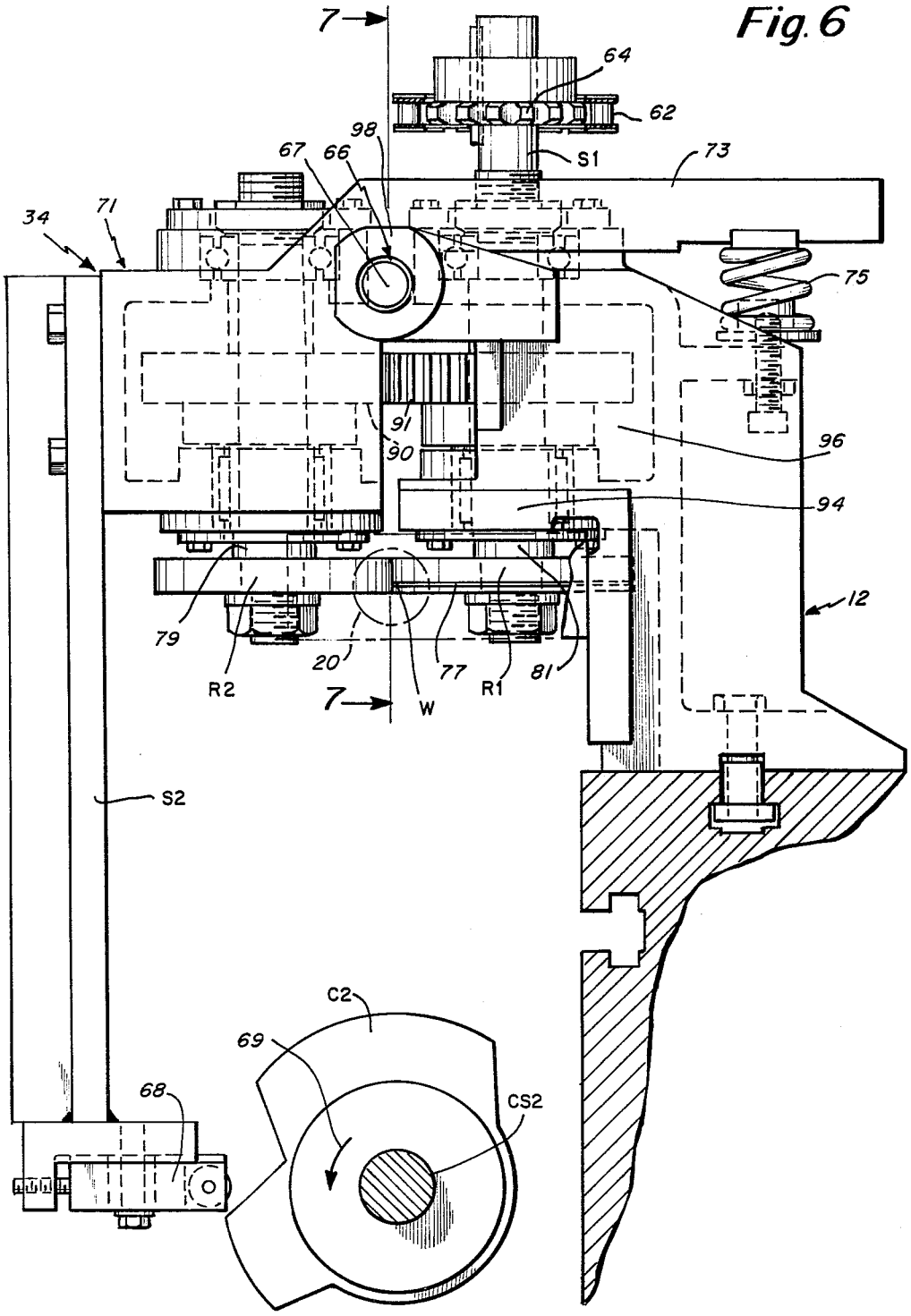
FIG. 6 is a cross-sectional view taken along line 6—6 of FIG. 3 showing in particular the operation associated with the feed rollers and the operable cam C2.

FIG. 6 is a cross-sectional view taken along line 6—6 of FIG. 3 to show particularly a preferred construction for the feed roll mechanism. Thus, in FIG. 6 there is shown the operative cam C2 mounted on the camshaft CS2. This is adapted for rotation in the direction of the arrow 69 shown in FIG. 6. Disposed in the path of travel of the cam is the cam follower 68 which is preferably adjustable and is secured to a bottom end of the arm member S2. This arm connects to an upper body 71 adapted to pivot at 66 as described previously in connection with FIG. 2. Coupled from the body 71 is a further arm 73 having associated therewith a heavy coil spring 75 which is adapted to bias the mechanism including the body 71 in a counter clockwise direction so that the cam follower 68 is properly biased against the cam surface of cam C2. The mounting arrangement shown in FIG. 6 is disposed generally in the intermediate section 12 of the frame. In FIG. 6 the feed rollers R1 and R2 are shown in their intermeshed position. The drive roller R1 preferably has a circumferential groove 77 for accommodating the wire W. Mounted on the shafts 79 and 81 associated with these drive rollers are intermeshed gears 90 and 91, respectively.

Figure 7:
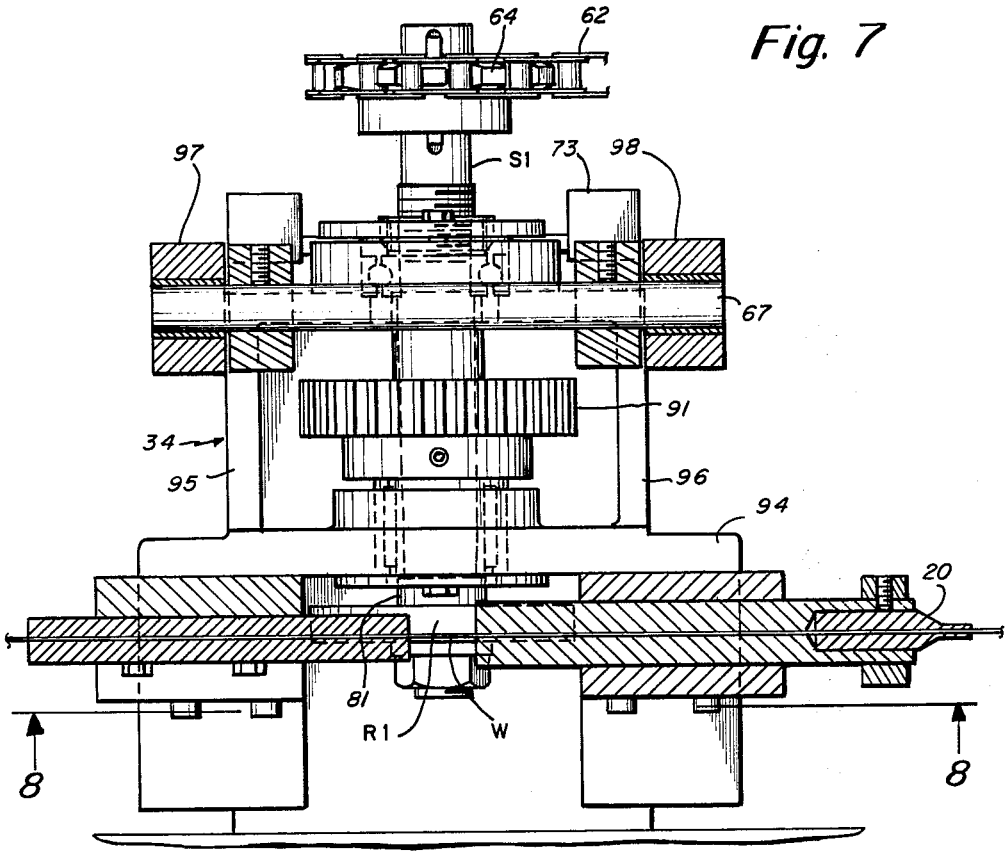
FIG. 7 is a cross-sectional view taken along line 7—7 of FIG. 6 and showing additional details for the feed roller assembly.

FIG. 7 is a cross-sectional view taken along line 7—7 of FIG. 6 and taken through the pivot point 66 which is defined in FIG. 7 by the shaft 67. As indicated in FIG. 7, the feed assembly 34 includes a base 94 and upright members 95 and 96. The shaft 67 is supported at its ends in members 97 and 98. FIG. 7 also shows the intermeshing gear 91 and the wire guide 20.

Figure 8:
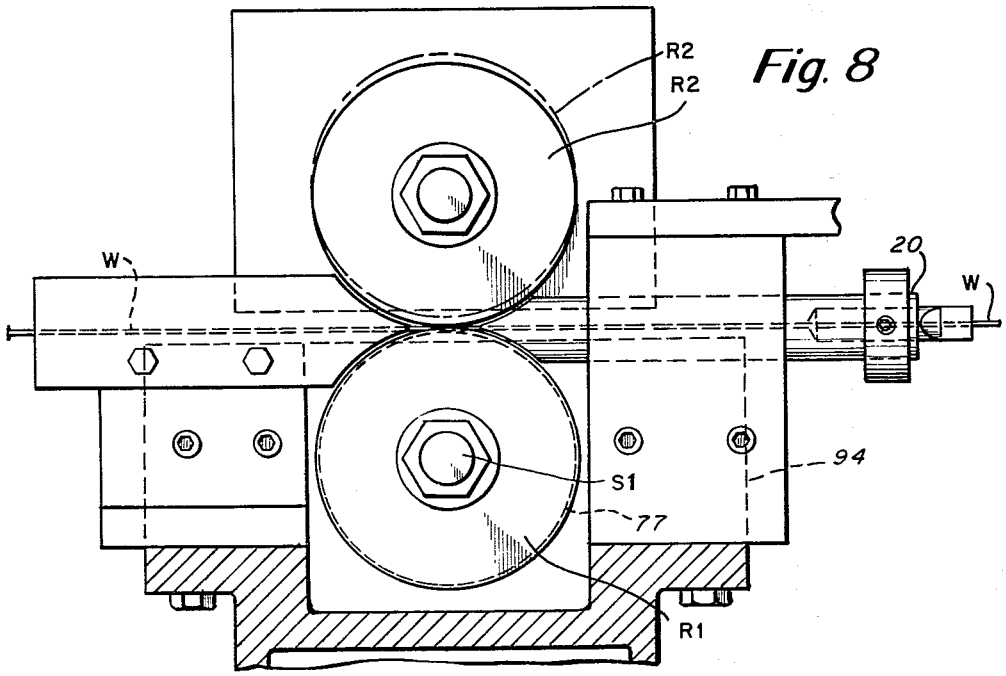
FIG. 8 is a cross-sectional view taken along line 8—8 of FIG. 7 showing further details of the feed roller assembly.

FIG. 8 is a cross-sectional view taken along line 8—8 of FIG. 7 clearly indicating the two drive rollers R1 and R2 along with the wire guide 20. The wire W is shown primarily in phantom in FIG. 8 being fed between the feed rollers. In the position shown in solid in FIG. 8, the wire is in a position to be fed. The feed roller R2 is also shown in phantom in its retracted position. This retracted position is established by the cam C2 at the high points of the cam. In this connection refer to FIG. 6.

Figure 9:
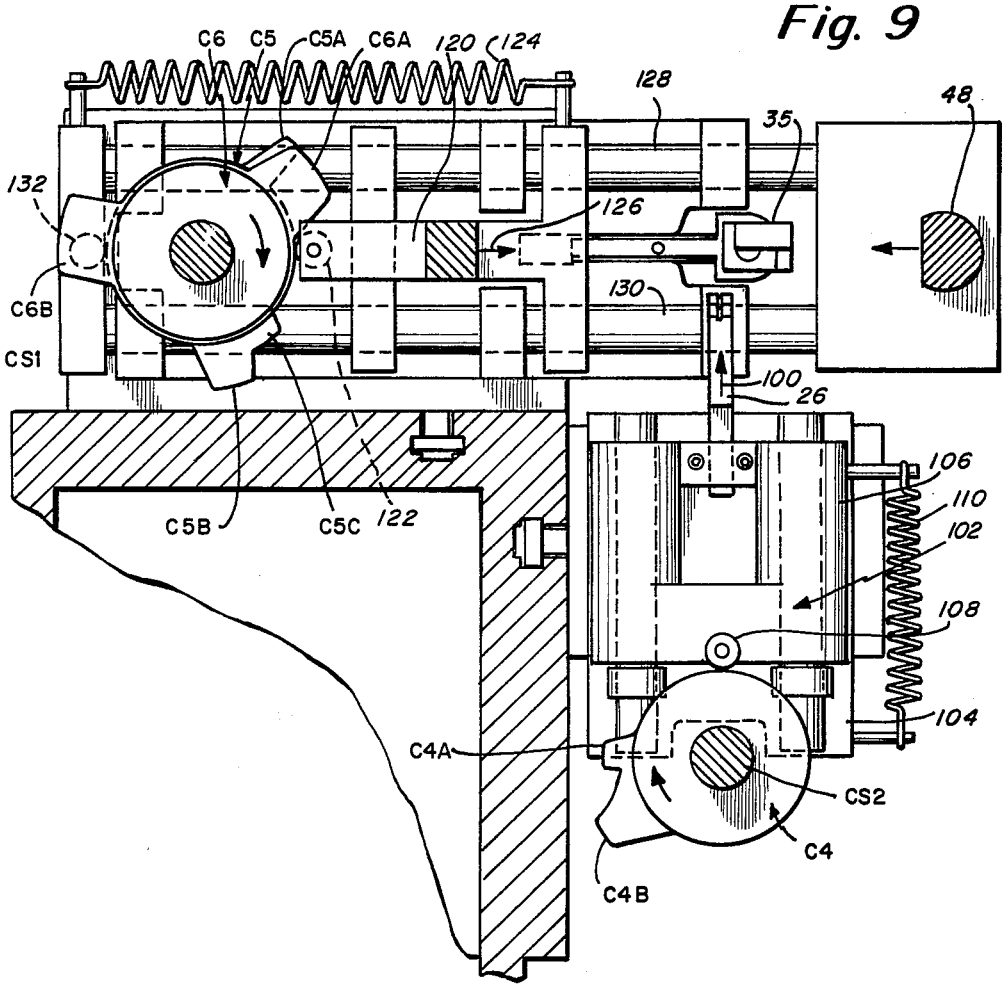
FIG. 9 is a cross-sectional view taken along line 9—9 of FIG. 3 showing operation in association with the cams C4, C5 and C6.
Figure 10:
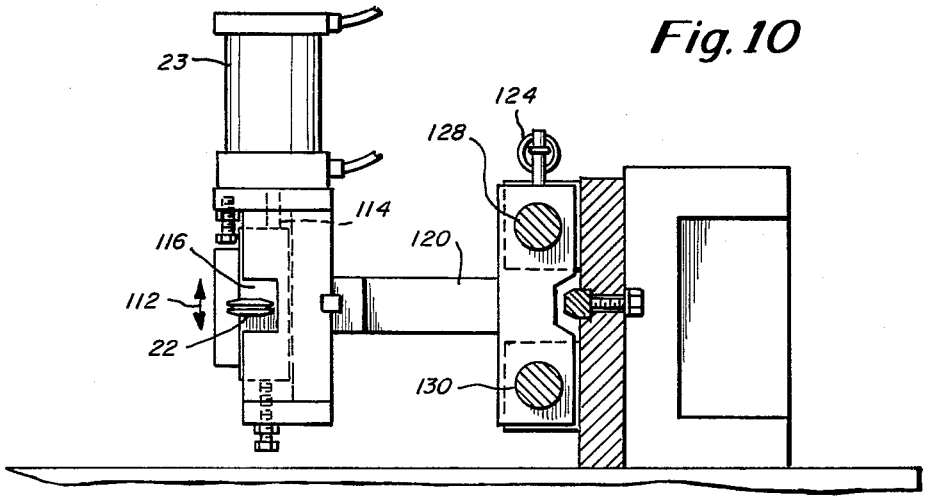
FIG. 10 is a cross-sectional view taken along line 10—10 of FIG. 3 showing operation associated with the deflection tool.

FIGS. 9 and 10 are cross-sectional views taken, respectively, along lines 9—9 and 10—10 of FIG. 3. The purpose of these views is to show the operation of the cams C4, C5 and C6 along with other components such as the operation of the deflection head 22 and associated air cylinder 23. In the diagram of FIG. 2, some of the components such as the bending tool 26, and associated operating cam follower, are shown schematically. The more precise details are shown in, for example, FIGS. 9 and 10 at least with regard to the mechanisms operated from the cams C4, C5 and C6.

The cam C4 operates the bending tool 26 to move this tool up and down. The tool is moved up in the direction of arrow 100 into an operative position as discussed in more detail hereinafter. The bending tool 26 is supported within a holder 102 that comprises a fixed member 104 and a movable member 106. It is the member 106 that supports the bending tool 26. The member 106 also carries a cam follower 108 that is in contact with the cam C4. A spring 110 biases the holder into its downward position with the cam follower preferably in firm contact with the surface of the cam C4. The cam C4 is mounted on the camshaft CS2. This cam has preferably two lobes C4A and C4B. The second lobe is higher than the first lobe and two lobes are disposed one adjacent to the other. Right angle spring bends are possible with the operation of this bending tool as operated from the cam C4.

FIG. 9 also clearly indicates the operation of the cam C6. This cam as indicated with previous discussions with reference to FIG. 2, operates the deflection tool 22. The tool 22 is supported for movement both vertically and horizontally as described in more detail hereinafter. In FIG. 10 the arrow 112 indicates the vertical movement of the deflection tool 22. This is occasioned by the operation of air cylinder 23 at the proper time. In this regard the air cylinder 23 has an output member 114 which couples to a support plate 116 for the deflection tool 22.

FIG. 10 shows the carriage 120 which has disposed at one end a cam follower 122 adapted for engagement with the cam C6. The carriage 120 is biased into contact with the cam by means of the biasing spring 124. In FIG. 9 the arrow 126 indicates the direction of movement of the carriage to its operative position representative of horizontal movement of the deflection tool. FIG. 9 also shows the stationary guide 35 described hereinafter. The carriage 120 is guided for movement on the rails 128 and 130.

The cam C6 has two lobes identified as lobes C6A and C6B disposed about 120° apart about the cam surface. The cam C6, by controlling the deflection tool, controls the making of the coils of the spring. Thus, the dwell angle of the particular lobe is in direct relationship to the length of the spring being coiled.

The cam C5 is adapted for control of the cutting tool 30 and bending anvil 24 which are commonly supported. In this regard, reference is made to FIG. 3 which shows the cam C5 for operating an associated cam follower 132. This operates, by way of members 48 and 49, the bending anvil 24 and cutting tool 30. This operation is described in further detail hereinafter. Thus, the cam C5 essentially performs a dual function. The cam lob C5A is associated with the cutting while the lobes C5B and C5C pertain to the bending action as occasioned by the bending anvil 24.

FIGS. 11–22 illustrate operation at the work station of the machine. There is described herein one of many different possible configurations of the components to construct a particular spring which is a double coiled spring with intermediate bends. The machine of this invention may also be set up for constructing various other types of springs and in this regard has extreme versatility. The modification of tooling can be accomplished quite readily to change to different spring configurations.

Figure 11:
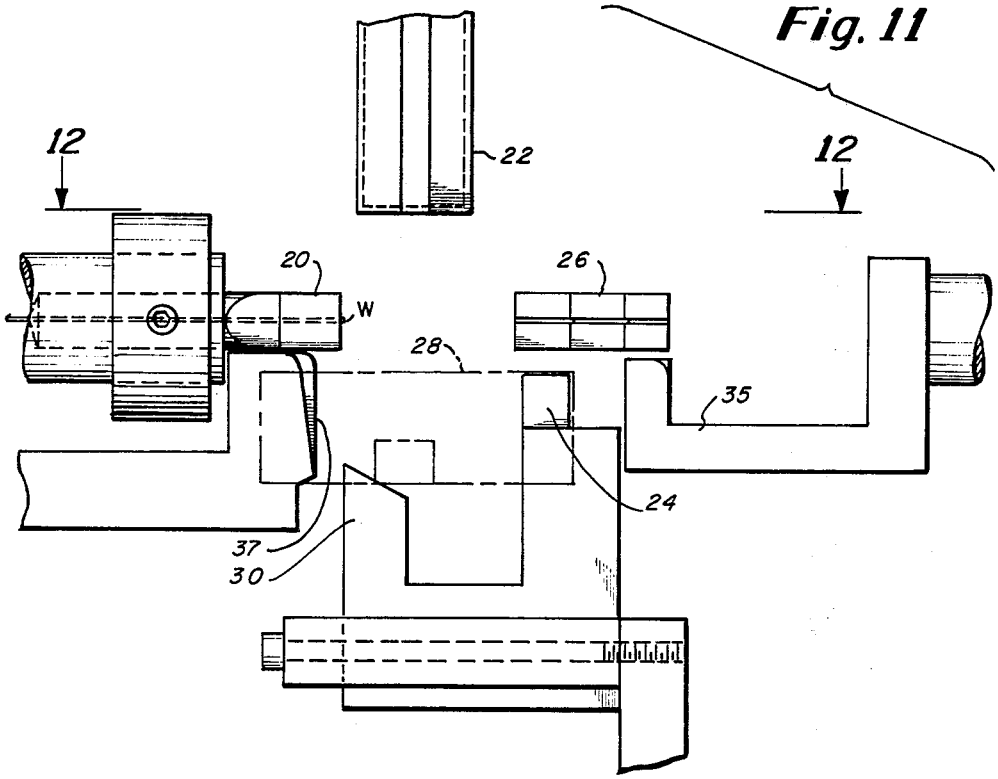
FIG. 11 is a plan view at the work station showing the different components located at the work station including the deflection tool, wire guide, bending tool, bending anvil, guide plate, and cutting tool.

FIG. 11 is in substance a plan view at the work station showing the deflection tool 22, wire guide 20, stationary guides 35 and 37, the guide plate 28, the bending tool 26, the bending anvil 24, and the cutting tool 30. Each of the components shown in FIG. 11 operate in a sequence as described hereinafter in constructing a spring of the type shown in FIG. 22.

Figure 12:
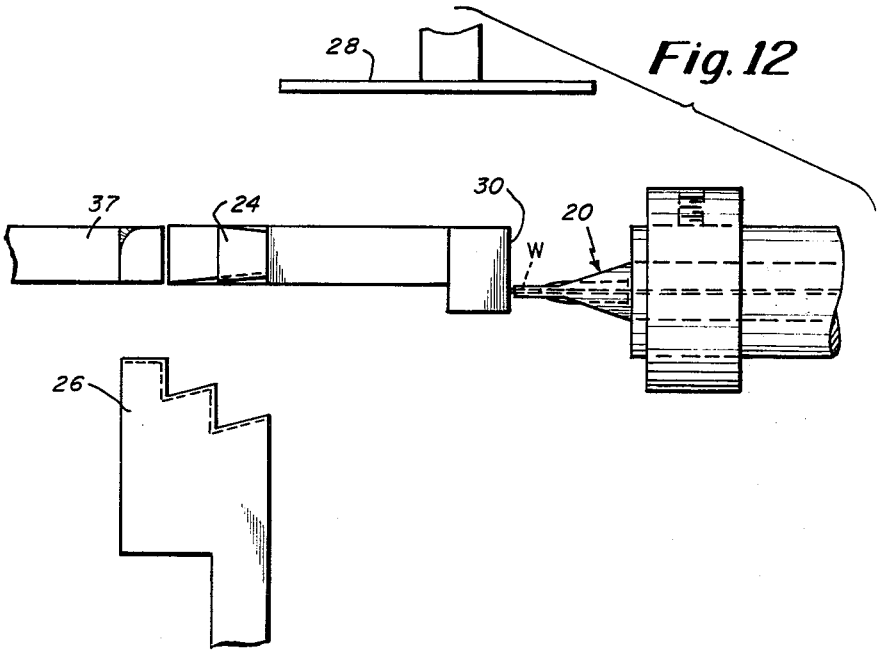
FIG. 12 is a front view of the components at the work station.

FIG. 12 is a cross-sectional view taken along line 12—12 of FIG. 11 and showing some of the components. For example, the guide plate 28 is disposed in its upward retracted position. Similarly, the bending tool 26 is in its lower inoperative position. The wire feed guide 20 is shown feeding a short length of wire W therefrom. FIG. 12 also shows the stationary guide 37 in place and the bending anvil 24. It can be assumed in FIG. 12 that the operation is at its very initiation with the cutting tool 30 having just been previously operated to terminate the making of a previous spring.

Figure 20:
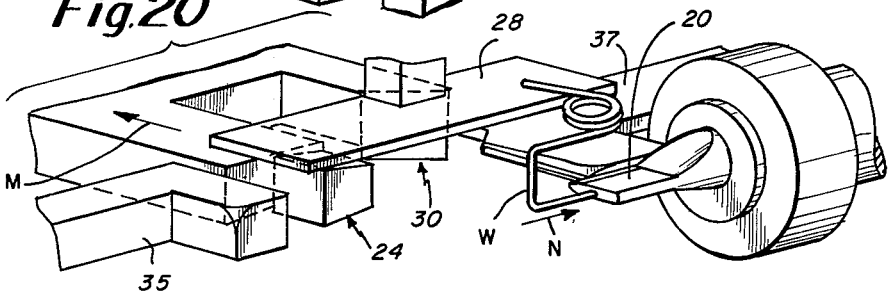
FIG. 20 is a perspective view at the work station showing the operation of the guide plate and the reversal of direction of wire feed so as to bring the spring back to the location of the deflection tool.
Figure 20:
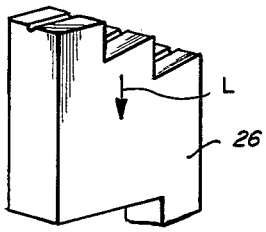
Figure 21:
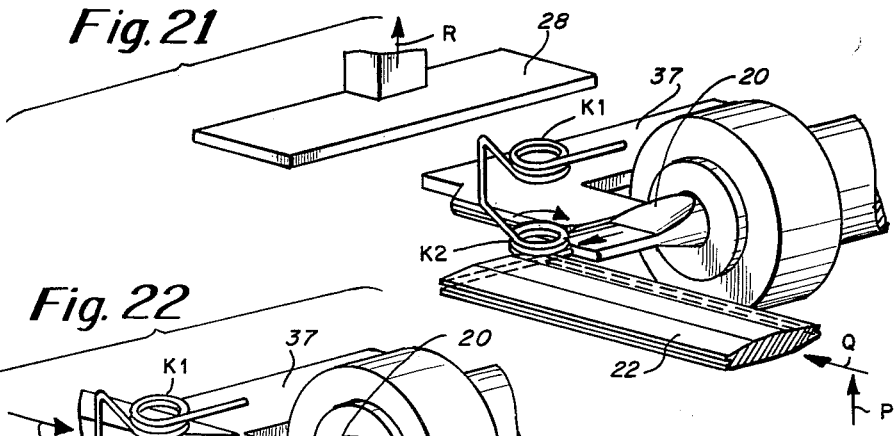
FIG. 21 is a perspective view at the work station showing the second action of the deflection tool in forming the second coil spring.
Figure 22:
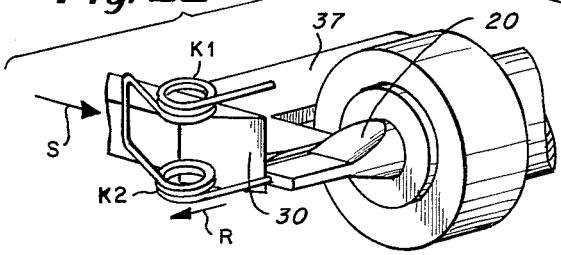
FIG. 22 is a perspective view at the work station showing the operation of the cutting tool to cut and complete the spring construction.

FIGS. 13–22 now depict the sequence of operation in making the final spring construction as shown in FIG. 22. The sequence of operation is also described in connection with the operation of other parts of the machine such as the operation of the feed rolls R1 and R2 and the operation of the snubber feed mechanism 32. In the operation of FIG. 13, most of the parts are withdrawn from their operative position. For example, the deflection tool 22 is out of the path of the wire feed and the bending tool 26 is in its lowermost inoperative position. However, the feed rollers are closed as depicted in FIG. 6 and the wire W is being fed at a predetermined rate. The other feed 32 is not operative at that time as the cam C1 is still on its lower cam track. The feed rollers R1 and R2 are in contact because the cam C2 is also not on its contacting lobe. The cam follower 68 is disposed in an intermediate space between the two cam lobes of cam C2. FIG. 13 shows the wire W at that time being fed in the direction of the arrow A.

After a predetermined length of wire W has been fed, then the sequence of FIG. 14 is initiated. The cam C2 is in a position to maintain the feed via the feed rollers. The deflection tool 22 moves down by operation of the air cylinder 23 and moves inwardly by operation of the cam C6. This operation is for forming the first coil K1 which is wound under the stationary guide 37 as depicted in FIG. 14. This may be a coil of two and one-half turns. To facilitate this coiling the deflection tool 22 has an end groove 22A. In FIG. 14 the arrow B represents the downward movement of the deflection tool as occasioned by operation of the cylinder 23 at the proper time while the arrow C represents inward movement of the deflection tool 22 as controlled by the cam C6. It is the cam lobe C6A illustrated in FIG. 9 of the cam C6 that controls the making of the first coil. It is the angle of the cam lobe C6A that determines the number of turns or coils. As the lobe C6A passes, then the deflection tool 22 is moved in the opposite direction to disengage from the wire W and the feed by way of the rollers ceases. The snubber machine feed now pushes the wire W in the direction of arrow D shown in FIG. 15. FIG. 15 also clearly shows the coil K1 having been made. Also, the deflection tool 22 is shown moved in the direction of the arrow E indicating its movement away from the work station. The feed roller feed was interrupted by virtue of one of the lobes on the cam C2 engaging the cam follower 68 to pivot the feed roller R2 out of engagement with the feed roller R1. However, the feed snubber 32 operates via the gears G17 and G18 and the follower arm 86 from the cam C1. Again, this feed movement is indicated by the directional feed of arrow D in FIG. 15.

Figure 16:
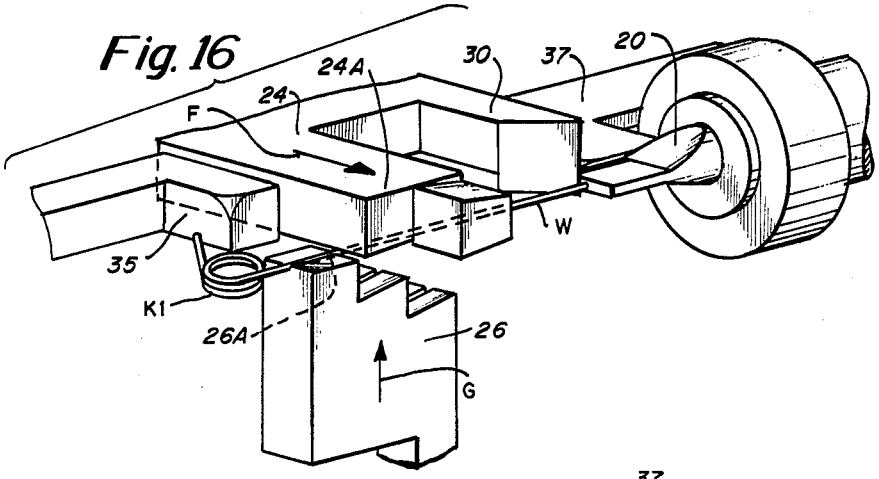
FIG. 16 is a perspective view at the work station showing the position of the bending tool and bending anvil preparatory to providing the first bend.

Reference is now made to FIG. 16 which shows the wire W with the coil K1 fed sufficiently from the feed guide 20 so that subsequent operation can now be accomplished. At this position, all wire feed ceases. In other words, the cam C1 is now on its lobe and no further feeding action can occur by way of the snubber 32. The bending anvil 24 now moves in to a position wherein the section 24A of the anvil overlies the bending tool 26. At the same time the bending tool 26 moves up capturing the wire W in its slot 26A. The cam C5 controls the operation of the bending anvil. The cam lobe C5B comes into operation first to move the bending anvil to its outermost position. It is noted that the lobe C5B has a higher cam surface so as to facilitate the longest move of the bending anvil. The bending tool 26 on the other hand is controlled from the cam C4. In this regard the movement to the position of FIG. 17 of the bending tool 26 is facilitated by the cam C4A which controls this first bending operation. In FIG. 16 the arrow F indicates the direction of movement of the bending anvil while the arrow G represents the upward movement of the bending tool 26.

Figure 17:
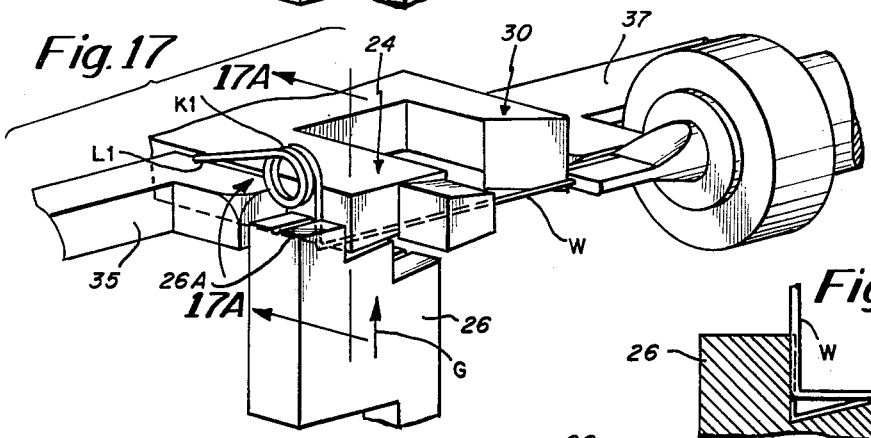
FIG. 17 is a perspective view at the work station showing the interaction of the bending tool and the bending anvil in providing the first spring bend.
Figure 17A:
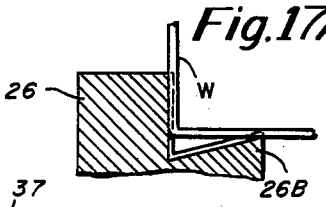
FIG. 17A is cross-sectional view taken along line 17A—17A of FIG. 17.

In FIG. 17 there is shown the sequence of finishing this first bend. In this regard, also note FIG. 17A which shows the tapered leg 26B of the bending tool which is a preferred construction to prevent damage to the spring in this bending action. In FIG. 17 the arrow G again represents the upward transition of the bending tool 26. Also, in FIGS. 16 and 17 there is no feed that is being accomplished. Furthermore, the leg L1 of the spring goes over the guide 35 and comes to rest against the guide.

Figure 18:
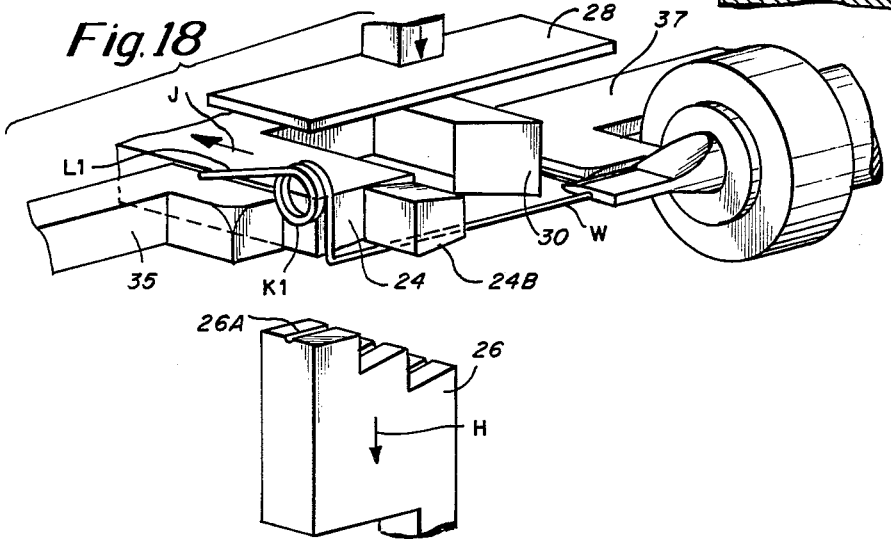
FIG. 18 is a perspective view at the work station showing the next sequence with the bending tool being lowered and the bending anvil moved to a second position.
Figure 19:
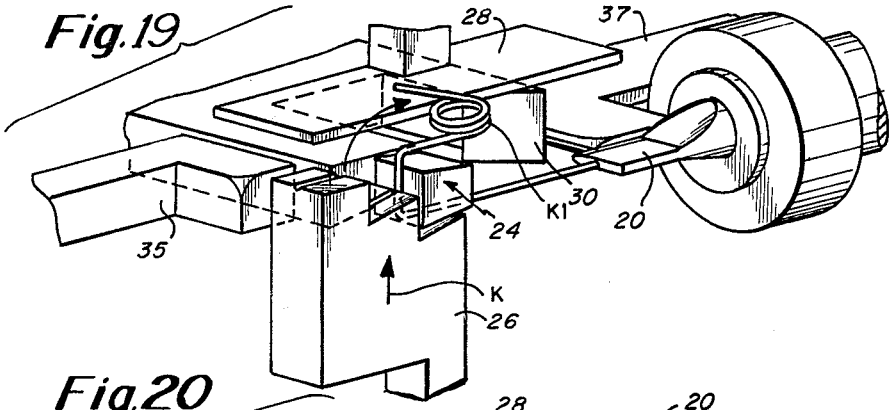
FIG. 19 is a perspective view at the work station showing the second bend being made in the spring by interaction of the bending tool and the bending anvil.

FIG. 18 illustrates the next step in constructing the spring. The bending tool 26 drops in the direction of the arrow H. As indicated previously, the bending tool 26 is controlled from the cam C4 and this dropping is occasioned by the cam follower falling intermediate the two cam lobes C4A and C4B. These cam lobes are close together because one bend follows the next. The section 24B of the bending anvil now comes into play. Thus, the bending anvil 24 is moved a short distance in the direction of arrow J to the position shown in FIG. 18. Also, the guide plate 28 starts to drop. The bending anvil 24 is controlled from the cam C5. It is the smaller lobe C5C that changes the movement of the bending anvil in the direction of arrow J to the position shown in FIG. 18. The machine is now ready for performing the second bend as described in FIG. 19.

Thus, with the bending anvil 24 in this position, the guide plate 28 moves to its down position. This occurs by operation of the cam C3. The cam follower associated with the cam C3 moves to the low track of the cam thus moving the guide plate to the position shown in FIGS. 19 and 20. The bending tool 26 moves up in the direction of arrow K to its highest position. This is controlled from the cam C4 and in particular from its lobe C4B which is the highest lobe indicating maximum movement of the bending tool 26 to its highest position. This upward movement of the bending tool 26 causes the second bend in the wire and provides a natural spring action lying the leg of the spring on top of the guide plate 28.

With reference now to FIG. 20, the bending tool 26 moves downwardly in the direction of arrow L. Also, the bending anvil 24 now retracts in the direction of arrow M and thus both of these pieces retract away from the work station. The feed snubber 32 now moves the wire in the opposite direction or in the direction of the arrow N shown in FIG. 20. The arrangement of the cam C1 with its follower arm 86 and the gears G17 and G18 provide for bidirectional movement of the feed snubber 32. Thus, previously the movement at the initiation of the cam lobe was in the direction of the work station. After the transition of the cam lobe and on the downward side of the cam lobe, the movement reverses and it is at that time that the movement goes in the direction of arrow N depicted in FIG. 20. The leg of the spring that is bent over the guide plate 28 simply transitions along the top surface of the guide plate 28.

The next sequence is depicted in FIG. 21 wherein the second coil K2 is wound. To accomplish this, the deflection tool 22 is again operated. The air cylinder 23 is operated and the deflection tool 22 is moved into engagement with the wire. This occurs at the same time as the feed rollers again close and feed is now re-initiated by way of the feed rollers R1 and R2. This re-initiation of the feed is occasioned by the cam lobe now being passed on the cam C2. The bent section of the coil spring rides on the stationary guide 37 as the second coil K2 is wound. The vertical and horizontal movement of the deflection tool 22 is illustrated by the respective arrows P and Q in FIG. 21. Also, the guide plate 28 is moved upwardly in the direction of arrow R to be out of the way as this second coiling operation commences.

In FIG. 22 the deflection tool 22 has been withdrawn but the feed rollers R1 and R2 continue to operate. Arrow R in FIG. 22 shows the direction of movement of the almost completely wound spring. Stop 2 moves in at the proper time to engage the rotating block. The adjustment of the position of the stop determines the length of the last leg of the spring. The one-way clutch 54 disengages and the spring loaded wedge absorbs the end of the drive. The lobe C5A of the cam C5 now comes into play and with the feed now interrupted the cutting tool 30 moves in the direction of arrow S in FIG. 22 for cutting the wire W to complete the making of the spring.

The stop 3 depicted in FIG. 4 is an indexing stop for providing a start position. The stop 1 is for the prevention of reverse rotation of the feed rollers. Thus, after the cutting tool has cut the wire, the cutter retreats. It is noted that the lobe C5A is quite short so that the cutter retreats quite quickly. The stops retract and the machine indexes back to the stop position wherein the start stop block, namely stop 3 in FIG. 4 is engaged.

Having described one embodiment of the present invention, it should be apparent to those skilled in the art that numerous other embodiments are contemplated as falling within the scope of this invention. Also, herein has been described a setup for constructing a double torsion spring. However, the machine of the present invention is adapted for universal operation and can also easily be adapted for making other types of springs such as a compression spring without legs. For this purpose the deflection tool 22 can be simply left in place without there being any spring ends formed. The machine of the present invention is also quite universal in operation in that, for example, while a torsion spring machine is capable of only one direction of rotation in coiling, with the attachment of a deflection winding mechanism, opposite rotational direction coiling is possible as with the double torsion spring described herein.

What is claimed is:

1. A wire coiling machine comprising:

means for receiving wire adapted to be formed into a spring, and extending along a wire feed path, first feed means disposed along the feed path and adapted to provide bi-directional wire movement, second feed means also disposed along the feed path and adapted to provide uni-directional wire movement, first control means for selectively controlling the first feed means to provide, during a first forming operation, wire movement toward a work station, temporary interruption of movement, followed by wire movement away from the work station, second control means for selectively controlling the second feed means to provide, during a second forming operation, selective wire feed to the work station, and means supported at the work station including control means therefor for performing bending, coiling or the like on the wire to complete formation of said spring.

2. A wire coiling machine as set forth in claim 1 wherein said first feed means comprises a snubber feed assembly including carriage means adapted for effecting bi-directional movement of the wire.

3. A wire coiling machine as set forth in claim 2 wherein said snubber feed assembly also includes bevel gear means.

4. A wire coiling machine as set forth in claim 2 wherein said control means includes a first camshaft and associated first cam and a cam follower coupled to the snubber feed assembly.

5. A wire coiling machine as set forth in claim 4 wherein said first cam has a lobe having a dwell angle corresponding to the period of interruption in movement between directional moves.

6. A wire coiling machine as set forth in claim 1 wherein said second feed means comprises a feed roller assembly including a pair of feed rollers.

7. A wire coiling machine as set forth in claim 6 wherein said feed rollers include a drive roller and a driven roller, the wire being fed therebetween.

8. A wire coiling machine as set forth in claim 7 wherein said second control means comprises selective drive means for driving the drive roller, and cam control means comprising a first camshaft and associated second cam and a cam follower.

9. A wire coiling machine as set forth in claim 8 including means responsive to said cam follower for pivoting the driven roller out of engagement with the drive roller.

10. A wire coiling machine as set forth in claim 9 wherein the selective drive means has presettable stop means for controlling the selective driving thereof.

11. A wire coiling machine as set forth in claim 8 including guide plate means at the work station and a third cam associated with the first camshaft for controlling movement of the guide plate means toward and away from the work station.

12. A wire coiling machine as set forth in claim 11 including a bending tool at the work station and a fourth cam associated with the first camshaft for controlling vertical movement of the bending tool.

13. A wire coiling machine as set forth in claim 12 wherein said fourth cam has two lobes in sequence of different height to move the bending tool to two different bending positions.

14. A wire coiling machine as set forth in claim 13 including a bending anvil at the work station and a fifth cam associated with a second camshaft for controlling horizontal movement of the bending anvil.

15. A wire coiling machine as set forth in claim 14 wherein said fifth cam has three lobes, two of which control displacement of the bending anvil to two different bending positions.

16. A wire coiling machine as set forth in claim 15 including a cutting tool at the work station, the third lobe of the fifth cam controlling the operation of the cutting tool.

17. A wire coiling machine as set forth in claim 16 wherein the bending anvil and cutting tool are commonly mounted and thus controllable by the same fifth cam.

18. A wire coiling machine as set forth in claim 17 including a deflection tool at the work station and a sixth cam associated with the second camshaft for controlling movement of the deflection tool.

19. A wire coiling machine as set forth in claim 18 including means for operating the bending tool and bending anvil in unison to form bends in the wire during a forming operation, while the deflection tool is operated to form coils in the wire, the bending and coiling sequences being performed mutually exclusively.

20. A wire coiling machine as set forth in claim 19 including means for controlling horizontal movement of the deflection tool by the sixth cam and vertical movement thereof by an air cylinder.

21. A deflection coiling attachment for a wire winding machine comprising:

means for receiving wire adapted to be formed into a spring and extending along a wire feed path, first feed means disposed along the feed path and adapted to provide wire movement to a work station, second feed means also disposed along the feed path and adapted to provide wire movement toward the work station, first control means for selectively controlling the first feed means to provide such movement during a first spring forming operation, deflecting means for deflecting the wire, second control means for selectively controlling the second feed means in association with the deflection means to control wire coiling during a second spring forming operation.

22. A deflection coiling attachment as set forth in claim 21 including means at the work station for performing bending during said first forming operation, said first feed means being controlled to bring the wire to a predetermined position for providing said bending.

23. A deflection coiling attachment as set forth in claim 21 wherein said second feed means is disposed downstream of said first means.

24. A deflection coiling attachment as set forth in claim 21 including means for confining the wire from the point of the second feed means to the deflection means so that the wire cannot be bent therebetween as it is imposed against the deflection head with substantial force.

* * * * *